United States Patent [19]

Ajioka et al.

[11] Patent Number: 4,467,292

[45] Date of Patent: Aug. 21, 1984

[54] MILLIMETER-WAVE PHASE SHIFTING DEVICE

[75] Inventors: James S. Ajioka; Raymond Tang, both of Fullerton, Calif.

[73] Assignee: Hughes Aircraft Company, El Segundo, Calif.

[21] Appl. No.: 431,975

[22] Filed: Sep. 30, 1982

[51] Int. Cl.[3] ..... H01P 1/19

[52] U.S. Cl. ..... 333/24.1; 333/21 R; 333/158

[58] Field of Search ..... 333/21 R, 21 A, 24.1, 333/157, 158

[56] References Cited

U.S. PATENT DOCUMENTS

| | | | |
|---|---|---|---|
| 3,736,535 | 5/1973 | Mohr et al. | 333/24.1 X |
| 3,760,300 | 9/1973 | Leahy | 333/158 |
| 3,772,619 | 11/1973 | Clarricoats | 333/21 R X |

OTHER PUBLICATIONS

Gimonet et al., *Optimization and Design of Millimeter Wavelength Phase Shifters,* 1979 IEEE MTT-S Int'l. Microwave Symposium Digest, Apr.-May 1979.

*Primary Examiner*—Paul L. Gensler

*Attorney, Agent, or Firm*—Thomas A. Runk; A. W. Karambelas

[57] ABSTRACT

A millimeter-wave phase shifter for use at high millimeter-wave frequencies is disclosed. The phase shifter employs continuous aperture ferrite and corrugated horns to make a reciprocal phase shifter in the frequency range of interest. Applied linearly polarized energy is expanded in cross-section by means of a first corrugated horn. The expanded energy is focused by a first lens, circularly polarized and applied to a ferrite phase shifting section. The phase shift applied to the energy is controlled by means of phase control circuitry and a yoke and coil arrangement. The phase-shifted energy is then converted to linearly polarized energy by a second circular polarizer focused by a second lens and contracted in cross-section by a corrugated horn. The use of the corrugated horns, polarizers, lenses and ferrite phase shifting components allows a much larger device to be fabricated and hence physical tolerances are reduced by an order of magnitude for the frequency range of interest. In addition, both the efficiency and power handling capability are greatly improved. Both reciprocal and nonreciprocal phase shifters are disclosed.

9 Claims, 3 Drawing Figures

MILLIMETER-WAVE PHASE SHIFTING DEVICE

BACKGROUND OF THE INVENTION

The present invention relates generally to phase shifting devices and more particularly to millimeter-wave phase shifting devices utilized at high millimeter-wave frequencies.

Phase shifting devices are commonly used at millimeter-wave frequencies, but have generally been limited except in experimental devices to use with frequencies below 35 gigahertz. These devices have been designed to transmit the dominant mode of the millimeter-wave energy. However, it is practically impossible to fabricate these devices for use in the high frequency range of 60 gigahertz and above, due to the small size and extremely high tolerances required in the dominant-mode device.

For example, the cross-section of a typical ferrite phase shifter is about 0.25 inches at 10 GHz. At 100 GHz, the cross-section is 0.025 inches, and the absolute tolerances ten times as stringent. Also, the high field concentration in the region of transition from standard waveguide to ferrite severely limits the power handling capability of such a phase shifter, even if it could be built. To date, due to these high tolerances and power limitations, no practical phase shifters of the conventional designs have been made for use at high millimeter-wave frequencies.

A discussion of several conventional phase shifters of related design may be found in publications entitled "A Dual Mode Latching, Reciprocal Ferrite Phase Shifter", by Charles R. Boyd, Jr., "An X-Band Reciprocal Latching Faraday Rotator Phase Shifter", by R. G. Roberts, and "An S-Band, Dual Mode Reciprocal Ferrite Phaser For Use At High Power Levels", by C. R. Boyd, Jr. et al, all published in IEEE G-MTT International Microwave Symposium Digest, 1970.

Accordingly, it would be an improvement to the phase shifting art to provide for a phase shifter which could be utilized at high millimeter-wave frequencies while allowing ease of manufacture. In addition, it would be an improvement to provide for a high frequency millimeter-wave phase shifter which could be used at high power levels.

SUMMARY OF THE INVENTION

To overcome the problems in the prior art, the present invention uses a relatively large slab of ferrite material and a corrugated horn to expand the cross-section of the millimeter-wave phase shifting section of the phase shifter. This allows a much larger ferrite element to be used in the phase shifting section and machining tolerances are reduced by an order of magnitude. In addition, the efficiency and power handling capability of the phase shifter are greatly improved. Also, the undesired higher order waveguide modes are eliminated by leakage and absorption at the boundary of the large ferrite section, while leakage and absorption of the desired mode is minimized.

Generally, a phase shifter in accordance with the present invention comprises a first section for expanding the cross-section of applied linearly polarized energy. The cross-section of the energy is expanded to a size which is many times the wavelength of the millimeter-wave energy. The cross-section is expanded so that the phase front is substantially planar. A second section is provided which converts the expanded linearly polarized energy into circularly polarized energy. Alternatively, the second section may be physically located prior to the first section since the polarization conversion and cross-section expansion processes are independent.

A phase shifting section is disposed to receive the expanded circularly polarized energy and introduce a controlled phase shift therein. A third section is disposed adjacent to the other end of the phase shifting section in order to contract the cross-section of the phase shifted energy and convert this energy into linearly polarized energy which is transmitted by the phase shifter. The phase shifter is substantially symmetrical in design, with both sides of the device having circular polarizers and means for expanding or contracting the cross-section of the energy travelling therethrough.

Hence, the concept of the invention is to expand the cross-section of the millimeter-wave energy to a size which allows the phase shifting section to be large in comparison to the size of a conventional phase shifter utilized in a particular frequency range. Consequently, the increased size of the phase shifting section coupled with correspondingly less stringent manufacturing tolerances allow the high frequency devices to be more easily manufactured.

More particularly, in one embodiment, the phase shifter comprises an input port and an output port on opposite ends thereof. First and second tapered corrugated horns are disposed adjacent to the input and output ports for expanding and contracting the millimeter-wave energy transmitted thereby. A ferrite phase shifting section is disposed between the two corrugated horns adjacent to the wide ends thereof. First and second nonreciprocal circular polarizers may be selectively disposed either at positions adjacent to the input and output ports, or between the corrugated horns and phase shifting section. The polarizers may be employed at any convenient position prior to or after the expansion/contraction section.

The phase shifting section comprises a ferrite region and electronic circuitry for controlling a magnetic field applied by a yoke and coil arrangement to the ferrite region in order to control the phase shift provided by the device. The core of the phase shifting section is filled with ferrite material. First and second dielectric lenses are also disposed on opposite sides of the phase shifting section. The lenses are employed to collimate and focus the millimeter-wave energy traversing through the phase shifting section. An absorbing material may also be disposed along the outer surfaces of the ferrite material to assist in absorbing unwanted higher-order energy modes.

Depending upon the frequency of the energy being phase shifted, the overall size of the phase shifting section may vary. For very high frequencies, on the order of 100 GHz, it may be necessary to employ the expanding/contracting corrugated horns described above. However, for lower frequencies, on the order of 60 GHz for example, extreme expansion is not usually necessary. Therefore, the corrugated horns need only be straight, and expanding cross-section horns are not required.

Also, the invention can be employed with standard millimeter waveguide sections designed for a particular wavelength range. And further, the phase shifting section may be employed inside a corrugated waveguide if one is normally employed in a system. In this case, the corrugated waveguide is interrupted and the ferrite phase shifting section inserted with appropriate impedance matching transformers and circular polarizers.

In operation, linearly polarized millimeter-wave energy is applied to the input port of the device. This energy is expanded by means of the first corrugated horn. The energy may be converted to circularly polarized energy either prior to or after the first corrugated horn. The expanded, circularly polarized energy is applied to the phase shifting section wherein a controlled amount of phase shift is introduced. The phase shifted energy is compressed in size by the second corrugated horn and reconverted back to linearly polarized energy prior to transmission by way of the output port.

The phase shifting of the energy is accomplished by means of the yoke and coil arrangement which controls the longitudinal magnetic field in the ferrite region of the phase shifting section. In devices wherein the energy is greatly expanded, dielectric collimating lenses are employed to collimate the energy passing through the phase shifting section. Also, absorbing material in the phase shifting section may be employed to absorb unwanted higher-order mode energy introduced by the phase shifting section.

The two corrugated horns are employed to expand and contract the cross-section of circularly polarized waves traversing the phase shifter. The circularly polarized waves correspond to the $HE_{11}$ mode of the energy distribution, and it is known that this mode provides a tapered field distribution in both the E and H planes with practically identical taper. Hence the field is circularly polarized over the entire aperture. This provides for maximum phase shift efficiency. The field almost tapers to zero at the boundary provided by the corrugated horn section. This is also important since it minimizes edge effects in the ferrite region of phase shifting section.

In addition, since the energy is expanded in cross-section, the use of larger ferrite components in the phase shifting section allows for higher power handling capability. Since the components of the phase shifter are relatively large, manufacture of these items is relatively simple, as compared to parts having extremely small size and tight tolerances which would be required in non-scaled phase shifter designs for use at high millimeter-wave frequencies.

The phase shifters described above are reciprocal devices when non-reciprocal circular polarizers are used. However, nonreciprocal phase shifters may also be constructed when reciprocal circular polarizers are used.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
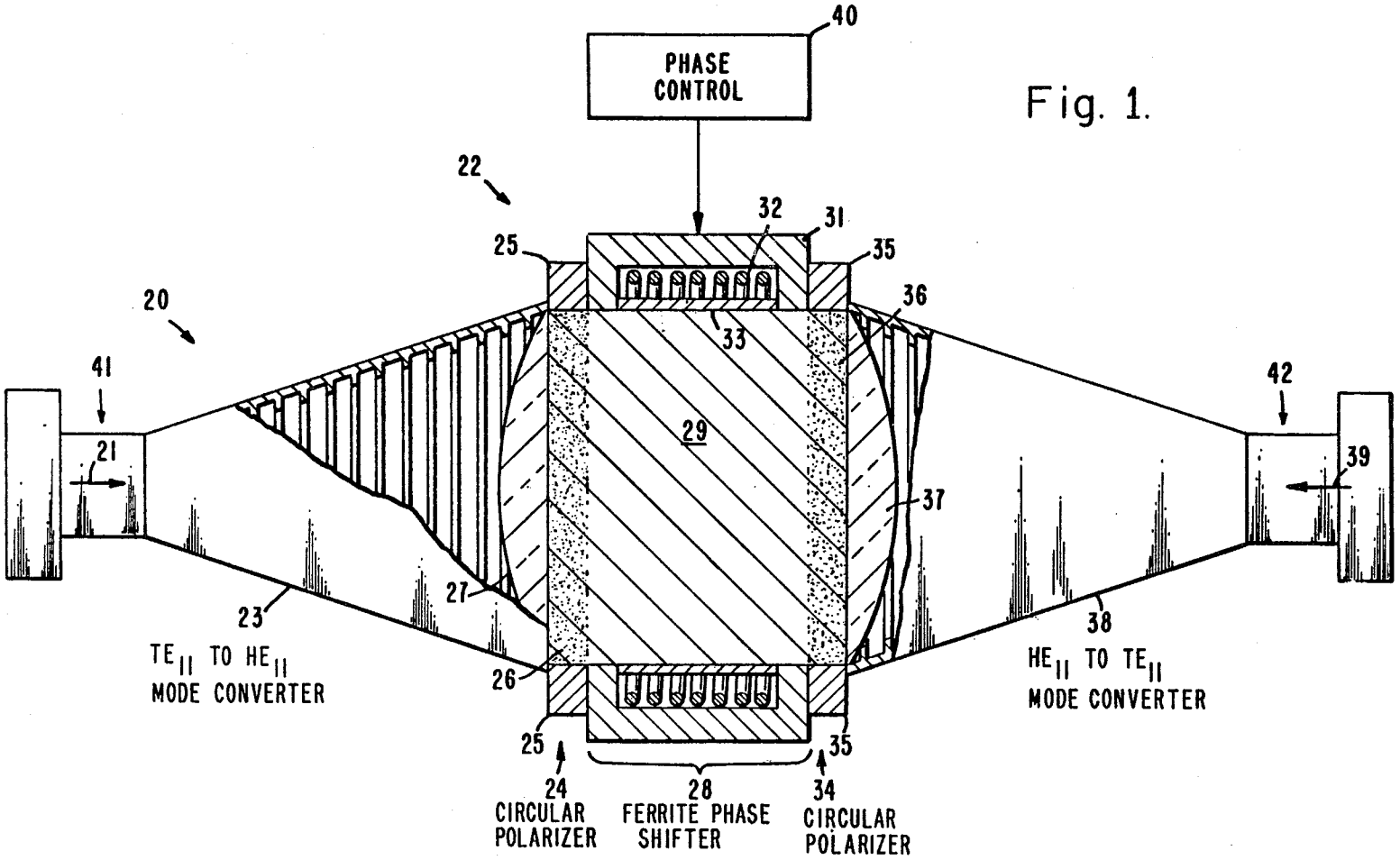
FIG. 1 illustrates a first embodiment of a phase shifter in accordance with the principles of the present invention.

Referring to FIG. 1, a first embodiment of a millimeter-wave phase shifter 20 in accordance with the principles of the present invention is shown. The phase shifter 20 comprises an input port 21, which may be a conventional millimeter waveguide section, or the like. This section may be rectangular, square, or circular. For the purposes of the discussion herein it is assumed that the various components in the phase shifting device 20 have a circular cross-section. A first tapered corrugated horn 23 has its narrow end disposed adjacent to the input port 21. The first horn 23 is a metal feedhorn of expanding cross-section which has a plurality of corrugations disposed on the inner surface thereof. These corrugations have a predetermined height and spacing relative to the wavelength of energy which is processed by the phase shifter 20. Typically, the height of the corrugations is greater than $\lambda/4$, where $\lambda$ is the wavelength of the energy. The horn 23 may be made of a metal such as copper or aluminum, or the like.

The wide end of the first tapered corrugated horn 23 is connected to a phase shifting section 22 of the phase shifter 20. The phase shifting section 22 comprises a first dielectric lens 27, a first nonreciprocal circular polarizer 24, phase shifting components 28, a second nonreciprocal circular polarizer 34, and a second dielectric lens 37. The dielectric lenses 27, 37 may be comprises of a dielectric material such as Teflon or other suitable material or they may be formed from the same ferrite material as the phase shifting section 22 ferrite region 29 and circular polarizer sections ferrite regions 26, 36 by making the ends of the ferrite region convex to form the collimating lens as an integral part. Each of the nonreciprocal circular polarizers 24, 34 is comprised of a fixed permanent magnet 25, 35 disposed peripherally on the surface of ferrite regions 26, 36, respectively. The stippled areas shown represent the areas within magnets 25, 35. The polarizers 24, 34 may have the magnets 25, 35 disposed either around the periphery of the ferrite 26, 36 (circular cross-section) or on the sides or at the corners of the ferrite 26, 36, respectively, (rectangular cross-section) as is known in the art. Also the ferrite 26, 36 may be part of ferrite region 29, a part to which yoke 31 does not extend, as further discussed below.

The phase shifting components 28 include a ferrite region 29 around which is disposed a yoke 31 and coil 32. A variety of configurations are available for the positioning and construction of the yoke 31 and coil 32. These components may extend completely around the ferrite region 29, or separate elements may be placed around the periphery of the ferrite region 29, as is known in the art. The ends of the yoke 31 are in contact with the ferrite region 29. Phase control circuitry 40 is coupled to the coil 32 in order to apply a latching current to the yoke 31. The latching current magnetizes the yoke 31 which controls the longitudinal magnetic field in the ferrite region 29, hence controlling the phase shift provided by the phase shifting section 22. An absorbing material 33, such as graphite, or the like, is disposed on the outer surface of the ferrite region 29. The absorbing material 33 is employed to absorb unwanted higher-order energy modes. A second tapered corrugated horn 38 is disposed between the second dielectric lens 37 and an output port 39. These elements are disposed in a substantially symmetrical manner to their counterparts on the other side of the phase shifting section 22 (horn 23 and input port 21).

The nonreciprocal circular polarizers 24, 34 are shown as being disposed at the ends of the ferrite region 29. This is generally done due to the ease of adding magnets 25, 35 to the ends of the ferrite region 29. However, the circular polarizers may also be disposed in the areas identified by arrows 41, 42. The waveguide in these areas would be filled with ferrite and the magnets 25, 35 would be disposed around the periphery, in the desired configuration.

Depending upon the configuration of the ferrite region 29 and the number and placement of the latching yokes 31, the coil (or coils) 32 utilized to magnetize the yokes 31 may have various configurations. The coil 32 may be one which completely surrounds the ferrite region 29. This, however, draws much power and has slow response speed. Alternatively, individual smaller yokes may be disposed around the periphery of the ferrite region 29, with each yoke having a separate coil wrapped around it. Numerous and varied other yoke and coil arrangements known to those skilled in the art may be employed.

In addition, it is necessary to provide for impedance matching at the boundaries of each of the components in the phase shifter 20. Impedance matching is well-known in the art, and is accomplished by means of quarter-wave transformers, disposed on the surfaces between components along the path traversed by the millimeter-wave energy. For instance, a quarter-wave transformer made of a dielectric material may be disposed between the lenses 27, 37 and the ferrite region 29, and on the outer surfaces of the lenses 27, 37. Use of impedance matching transformers is well-known in the art.

In operation, linearly polarized millimeter-wave energy at the dominant $TE_{11}$ mode is applied to the input port 21. The first corrugated horn 23 expands the linearly polarized energy and transforms it into the $HE_{11}$ mode. This expanded energy field is in turn collimated by the first dielectric lens 27 prior to passage of the energy through the ferrite region 29. The expanded energy is converted from linearly polarized energy into circularly polarized energy by the first circular polarizer 24. The phase control circuitry 40 controls the current through the coil 32 which, in conjunction with the yoke 31, introduces a predetermined phase shift into the energy traversing through the ferrite region 29.

This phase shifted energy is then focused by means of the second dielectric lens 37 and reduced to a narrow beam size by means of the second corrugated horn 38. The phase shifted circularly polarized energy is also converted to linearly polarized energy by the second circular polarizer 34. This energy is coupled out of the phase shifter 20 at the output port 39 as a linearly polarized wave.

The tapered corrugated horns 23, 38 are employed in conjunction with the use of circularly polarized energy to provided a tapered field distribution in both the E and H planes with practically identical taper. The field is circularly polarized over the entire aperture which maximizes phase shifting efficiency. The field tapers to zero at the boundary provided by the horns 23, 38 which minimizes edge effects in the ferrite region 29.

The electric field lines in the first corrugated horn 23 are substantially parallel over the entire cross-section. Therefore, when two orthogonally polarized modes in phase quadrature are combined to form circular polarization, the wave is circularly polarized at every point in the entire cross-section. Since the ferrite region 29 is longitudinally magnetized by means of the yoke and coil arrangement, the phase is shifted oppositely for right and left circular polarizations, respectively. Thus the wave is substantially circularly polarized in one sense to provide for the most efficient phase control.

In the corrugated horns 23, 38, the corrugations create the effect of a magnetic wall thereby causing the tangential magnetic field (and the normal electric field) to go to zero at the boundary resulting in a taper in the E plane. In the H plane, the metallic wall is an electric wall and the tangential E field (and the normal H field) go to zero at the boundary, the result is an equally tapered field in both planes. Since the field lines are also straight, an amplitude-perpendicular relationship for the field components of the orthogonally polarized wave is present so that a substantial polarization is achieved at every point in the cross section.

In conventional phase shifters having large cross-sections, higher order modes are present. The use of the corrugated horns 23, 38 minimizes generation of higher order modes. However, due to manufacturing imperfections and asymmetries, a small amount of higher order mode generation is likely, resulting in loss spikes in the frequency band of interest. Absorption of these undesired modes alleviates this problem. Absorption occurs in the walls of the phase shifter 20, and in the absorbing material 33, in the area surrounding the ferrite phase shifting section 22. The higher order modes leak out of the ferrite region 29 and into the surrounding absorbing material 33. The $HE_{11}$ mode leakage is minimized due to the fact that the field tapers to zero at the boundry.

Figure 2:
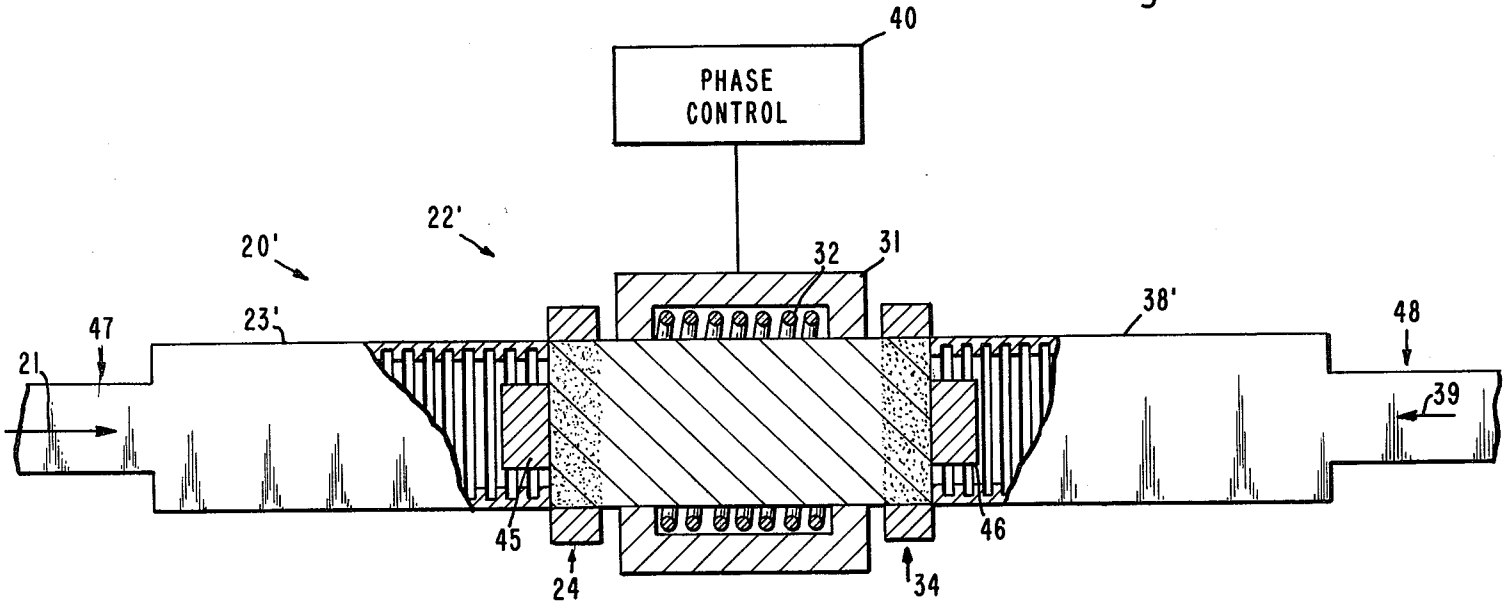
FIG. 2 illustrates a second embodiment of a phase shifter in accordance with the principles of the invention.

Referring to FIG. 2, a second embodiment of a phase shifter 20′ in accordance with the present invention is shown. The design of this phase shifter 20′ is similar to the embodiment of FIG. 1. However, in the second embodiment, the corrugated horns 23′, 38′ are straight sections of corrugated waveguide which do not have an expanding or contracting taper. This phase shifter 20′ is employed for use with lower millimeter-wave frequencies, where cross-sectional expansion requirements are not quite as great.

The corrugated horn 23′ is utilized to expand the energy cross-section and convert the energy from the dominant $TE_{11}$ mode to the $HE_{11}$ mode. Nonreciprocal circular polarizers 24, 34 may be employed at opposite ends of the ferrite phase shifting section 22′ at the juncture of that section and the corrugated horns 23′, 38′. Alternatively, the polarizers 24, 34 may be placed prior to and after the corrugated horns 23′, 38′, respectively, as indicated by the arrows 47, 48, next to input and output ports 21, 39. The waveguide section must be filled with ferrite material, or the like, in the areas indicated by arrows 47, 48, and surrounded by permanent magnets, as discussed above. Impedance matching transformers 45, 46 are shown positioned on either side of phase shifting section 22′.

Figure 3:
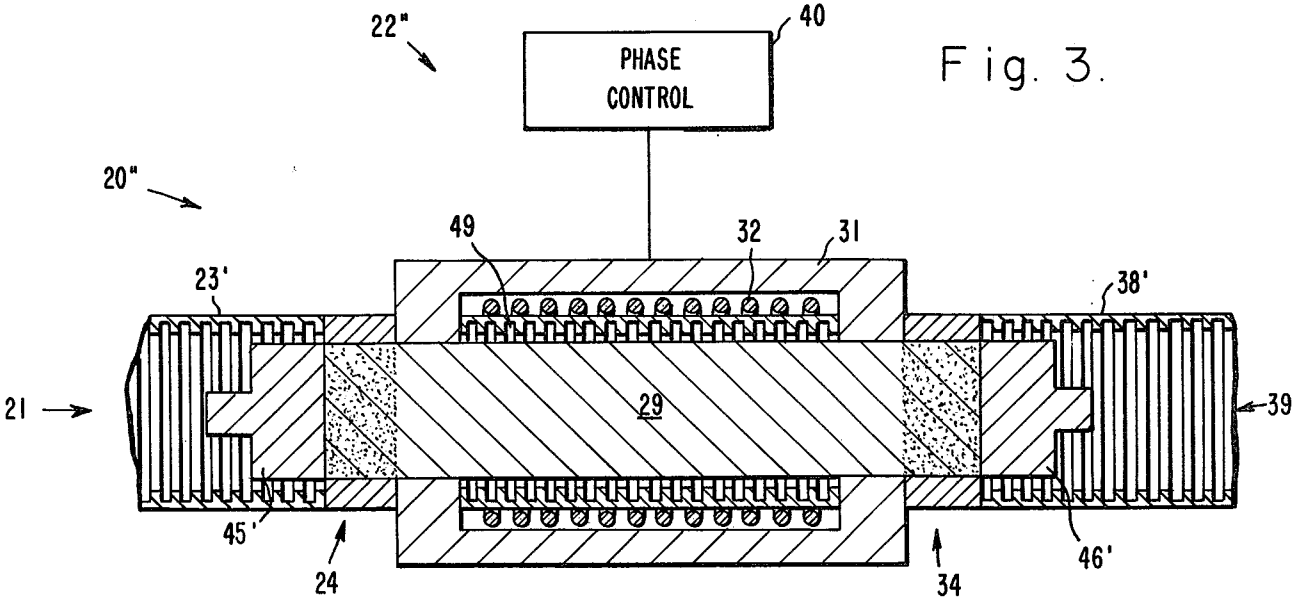
FIG. 3 illustrates a third embodiment of a phase shifter in accordance with the principles of the invention.

FIG. 3 illustrates a third embodiment of a phase shifter 20″ in accordance with the present invention. In this embodiment, the phase shifting section 22″ is inserted in an existing corrugated waveguide. The corrugated waveguide is interrupted (hence having three sections 23′, 38′ and 49) and the enlarged phase shifting section 22″ inserted. The phase shifting section is substantially identical to that described with reference to FIG. 2, with the nonreciprocal circular polarizers 24, 34 being an extension of the phase shifting section. Impedance matching transformers 45', 46' are shown positioned on either side of phase shifting section 22''.

The above-described phase shifters are reciprocal in design where non-reciprocal circular polarizers 24, 34 are used. Nonreciprocal phase shifters may be also designed in accordance with the principles of the present invention by using reciprocal circular polarizers as polarizers 24, 34.

Thus, there has been described new and improved phase shifter designs which may be used at millimeter wavelengths above 35 gigahertz. Both reciprocal and nonreciprocal devices may be designed in accordance with the principles of the present invention. The new designs allow high-frequency millimeter-wave phase shifters to be more easily manufactured. Also, the power handling capability of these devices is increased compared with conventional phase shifter designs for use at these frequencies.

It is to be understood that the above-described embodiment is merely illustrative of one of the many specific embodiments which represent applications of the principles of the present invention. Clearly, numerous and varied other arrangements may be readily devised by those skilled in the art without departing from the scope of the invention.

What is claimed is:

1. A millimeter-wave phase shifter comprising:

first means for expanding the energy cross-section of applied dominant $TE_{11}$ mode linearly polarized energy and converting it to circularly polarized $HE_{11}$ mode energy;

phase shifting means for introducing a controlled amount of phase shift into the circularly polarized $HE_{11}$ mode energy; and second means for contracting the energy cross-section of the phase shifted circularly polarized $HE_{11}$ mode energy and converting it to linearly polarized dominant $TE_{11}$ mode energy.

2. The millimeter-wave phase shifter of claim 1 wherein said phase shifting means comprises:

a ferrite region including a yoke and coil arrangement disposed therearound to control the phase shift applied to energy processed by said phase shifting means.

3. The millimeter-wave phase shifter of claims 1 or 2 wherein said first and second means comprise:

a pair of corrugated horns and a pair of circular polarizers disposed adjacent to respective said horns.

4. A millimeter-wave phase shifter comprising:

an input port and an output port;

first and second corrugated horn sections coupled respectively at one end to said input and output ports;

first and second circular polarizers coupled respectively to said first and second horn sections at opposite ends from said input and output ports; and a phase shifting device coupled to said first and second polarizers wherein said device comprises means for controlling the phase shift of energy traversing said first and second polarizers.

5. The millimeter-wave phase shifter as recited in claim 4 further comprising first and second dielectric lenses wherein:

said first lens is coupled to said first horn section and said first polarizer; and said second lens is coupled to said second horn section and said second polarizer.

6. The millimeter-wave phase shifter as recited in claim 5 wherein said corrugated horn sections are tapered, having narrow ends and broad ends, said narrow ends coupled to said input and output ports.

7. A millimeter-wave phase shifter comprising:

an input port and an output port;

first and second circular polarizers coupled respectively to said input port and said output port;

first and second corrugated horn sections coupled respectively at one end to said first and second polarizers; and a phase shifting device coupled to said horn sections wherein said device comprises means for controlling the phase shift of energy traversing said first and second polarizers.

8. The millimeter-wave phase shifter as recited in claim 7 further comprising first and second dielectric lenses wherein:

said first lens is coupled to said first horn section and said phase shifting device; and said second lens is coupled to said second horn section and said phase shifting device.

9. The millimeter-wave phase shifter as recited in claim 8 wherein said corrugated horn sections are tapered, having narrow ends and broad ends, said narrow ends coupled to said first and second polarizers.

* * * * *